US005984801A

United States Patent [19]

Mason

[11] Patent Number: 5,984,801

[45] Date of Patent: Nov. 16, 1999

[54] GOLF ALIGNMENT TRAINING APPARATUS AND METHOD

[76] Inventor: Robert B. Mason, 20726 Jayhawk, Chugiak, Ak. 99567

[21] Appl. No.: 09/129,318

[22] Filed: Aug. 5, 1998

[51] Int. Cl.[6] ..... A63B 69/36

[52] U.S. Cl. ..... 473/270; 473/272; 434/252; 33/508

[58] Field of Search ..... 473/218, 452, 473/266, 270, 271, 272, 273, 261–265; 434/252; 33/508; D21/791, 792, 793

[56] References Cited

U.S. PATENT DOCUMENTS

| | | |
|---|---|---|
| D. 244,791 | 6/1977 | Sullivan, Jr. . |
| D. 272,379 | 1/1984 | Cachola . |
| D. 338,512 | 8/1993 | Crow et al. . |
| D. 357,298 | 4/1995 | Vines . |
| 1,517,555 | 12/1924 | Graham . |
| 2,169,407 | 8/1939 | Crowley . |
| 3,229,981 | 1/1966 | Taber . |
| 3,459,429 | 8/1969 | Green . |
| 3,615,095 | 10/1971 | Lafontaine . |
| 3,887,193 | 6/1975 | Stanley . |
| 4,164,352 | 8/1979 | O'Brien . |
| 4,322,084 | 3/1982 | Reece . |
| 4,384,718 | 5/1983 | Cachola . |
| 4,538,815 | 9/1985 | Poirier . |
| 4,583,739 | 4/1986 | Kabbany . |
| 4,718,674 | 1/1988 | Henry . |
| 4,736,952 | 4/1988 | Taft et al. . |
| 4,779,872 | 10/1988 | Bisbee . |
| 4,805,913 | 2/1989 | Bott . |
| 4,915,387 | 4/1990 | Baxstrom . |
| 5,014,994 | 5/1991 | Peters . |
| 5,139,263 | 8/1992 | Feo . |
| 5,203,453 | 4/1993 | Dirito . |
| 5,246,234 | 9/1993 | Zambelli . |
| 5,294,125 | 3/1994 | Mietz . |
| 5,335,915 | 8/1994 | Baudier . |
| 5,464,220 | 11/1995 | Hansen et al. . |
| 5,611,738 | 3/1997 | Lundquist . |
| 5,645,494 | 7/1997 | Dionne et al. . |

FOREIGN PATENT DOCUMENTS

| | | | |
|---|---|---|---|
| 2 254 008 | 9/1992 | United Kingdom | 273/187 R |

*Primary Examiner*—Sebastiano Passaniti
*Attorney, Agent, or Firm*—Mason & Associates, P.A.; Dennis G. LaPointe

[57] ABSTRACT

A portable golf training apparatus and method of use for teaching golfers the consistent achievement of proper ball placement, correct alignment, proper foot placement and stance, and for providing a visual reference or target line in relation to alignment and foot position.

14 Claims, 3 Drawing Sheets

GOLF ALIGNMENT TRAINING APPARATUS AND METHOD

BACKGROUND OF THE INVENTION

1. Field of the Invention

The invention relates to golf alignment training apparatus and methods of using such apparatus to teach and train golfer's proper stance, correct alignment, proper foot placement, proper ball placement and to provide a visual memory reference for aiming at the target.

2. Description of Related Art

Golf aids and training devices and methods are generally known in the art. However, most known art requires complex adjustment of the training device, often for each club used or dependent on the height and size of the golfer, or the device is not portable or at least compact enough to store in a golf bag zippered compartment.

Known related art includes the golf training aid depicted in U.S. Pat. No. 5,294,125 to Mietz, and the golf stance and swing practice device of U.S. Pat. No. 4,384,718 to Cachola. Other known related art training devices include U.S. Pat. No. 5,464,220 to Hansen et al., U.S. Pat. No. 4,718,674 to Henry, U.S. Pat. No. 4,583,739 to Kabbany, U.S. Pat. No. 5,246,234 to Zambelli, and U.S. Pat. No. 5,611,738 to Lundquist.

None of the devices in the above references solve the problem of using a training aid without complicated adjustments. Most, if not all, all of the prior art devices require the golfer to assemble the training device and/or set angles or distances on members of the device. If done improperly, the effectiveness of the device is diminished. The present invention requires only that it be laid flat on the ground or on a hitting mat and secured with tees or tape if the wind is blowing or if the golfer desires. Further, these prior art devices require that they be folded up in a proper manner and are cumbersome to store in a golf bag. The present invention can be wadded up and stuffed in a pocket on the golf bag. The embodiment of the present invention depicting a rigid training apparatus cannot be folded but is generally intended to be used in the same place over and over again by multiple golfers, for example, at a driving range or at a golf school.

Further, when using one of the referenced devices, the player must move the entire device after taking a divot out of the ground. Since taking a divot is a normal and preferred consequence of a golf swing especially with shorter irons, these devices must be moved after every shot. The present invention allows the golfer to hit numerous balls with divots without moving the invention.

Further, the prior art does not provide a target line, giving the golfer a visual reference for aiming shots, which is an essential feature of the present invention.

SUMMARY OF THE INVENTION

The present invention is a training apparatus for teaching consistent achievement of proper ball placement, correct alignment, proper foot placement and stance, and for providing a visual reference or target line in relation to foot position and alignment. The present invention is also a method of using the training apparatus.

An object of the present invention would provide a device which can teach golfers proper alignment and to train golfers how to achieve proper alignment when swinging a golf club. A further object of the invention is to teach golfers what a proper stance is and to train a golfer to achieve a proper stance when swinging. In addition, another object is to teach golfers where the ball should be positioned for a swing with each club and to train golfers to ensure the ball is properly positioned when swinging. Another object of the invention is to teach golfers how to insure that their feet are the same distance from the ball for a given club when swinging and to learn that the distance will vary with each club. A very important object of the invention is to provide a visual reference for the golfer to learn how to sight down the target line at the target when swinging, thus establishing a memory sensory impression of a visualized tunneled line of sight to a target while at the same time visualizing foot position and alignment relative to ball placement.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1:
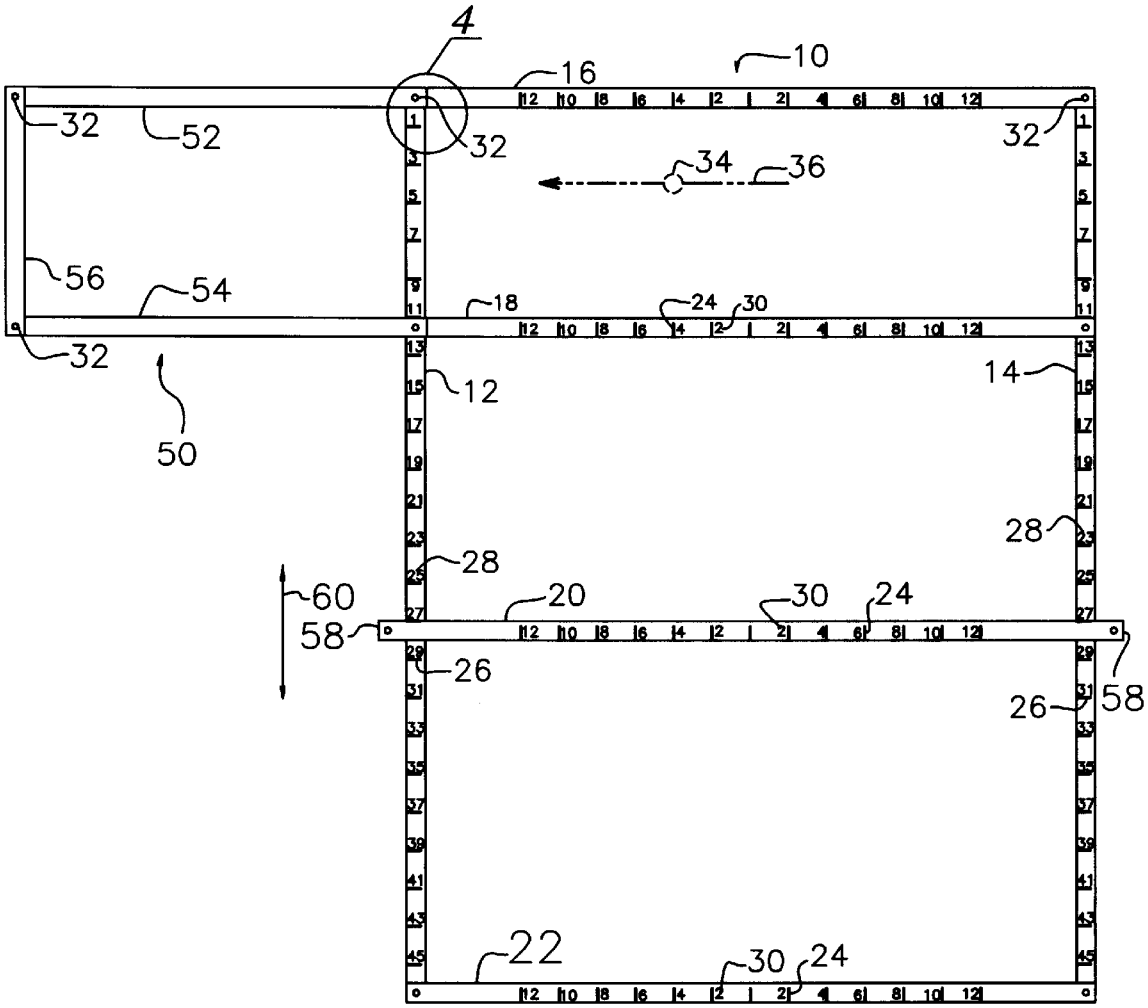
FIG. 1 is a perspective view of the present invention.
Figure 2:
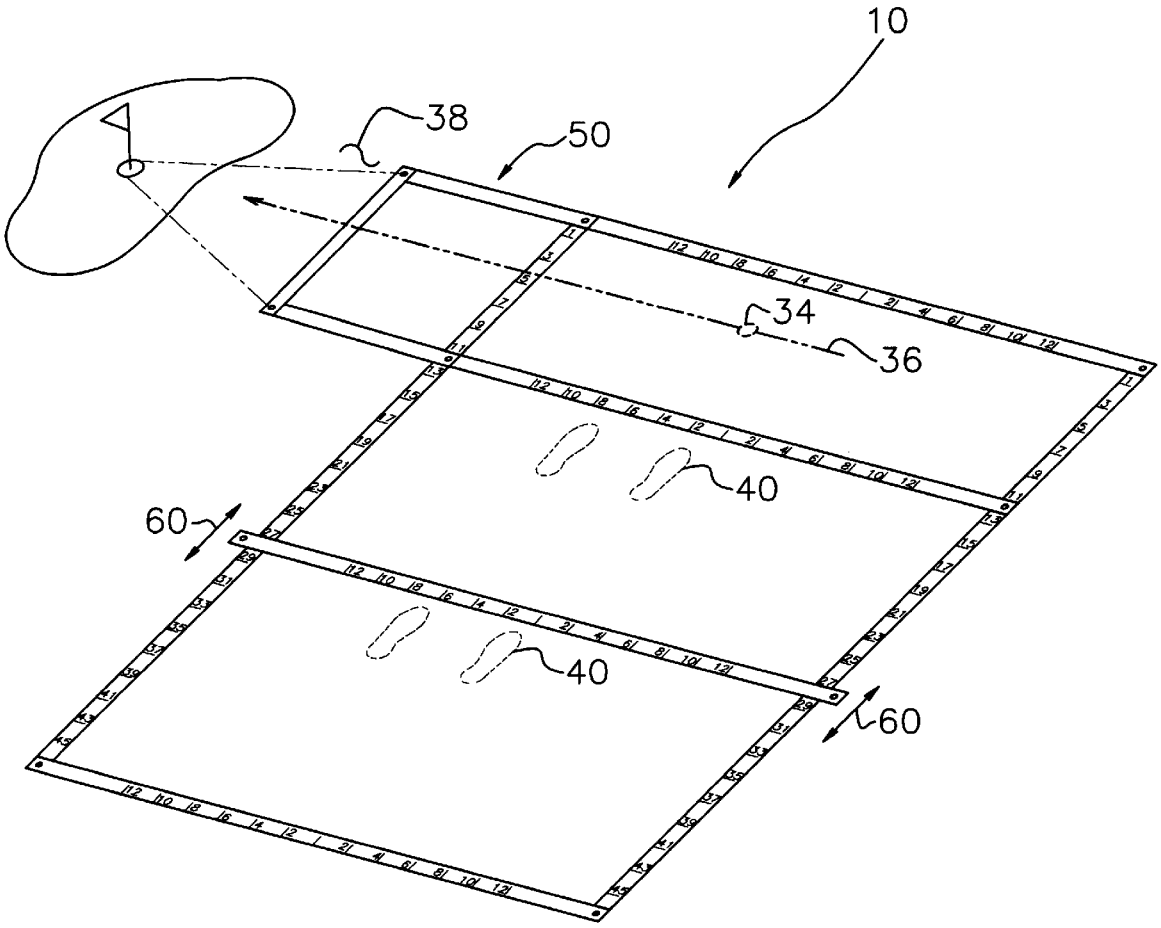
FIG. 2 is a perspective view of the apparatus depicting a target green and pin with flag, and an object of the present invention, being the visualized tunneled line of sight to a target (the target and visualized tunneled line of sight shown in phantom).
Figure 3:
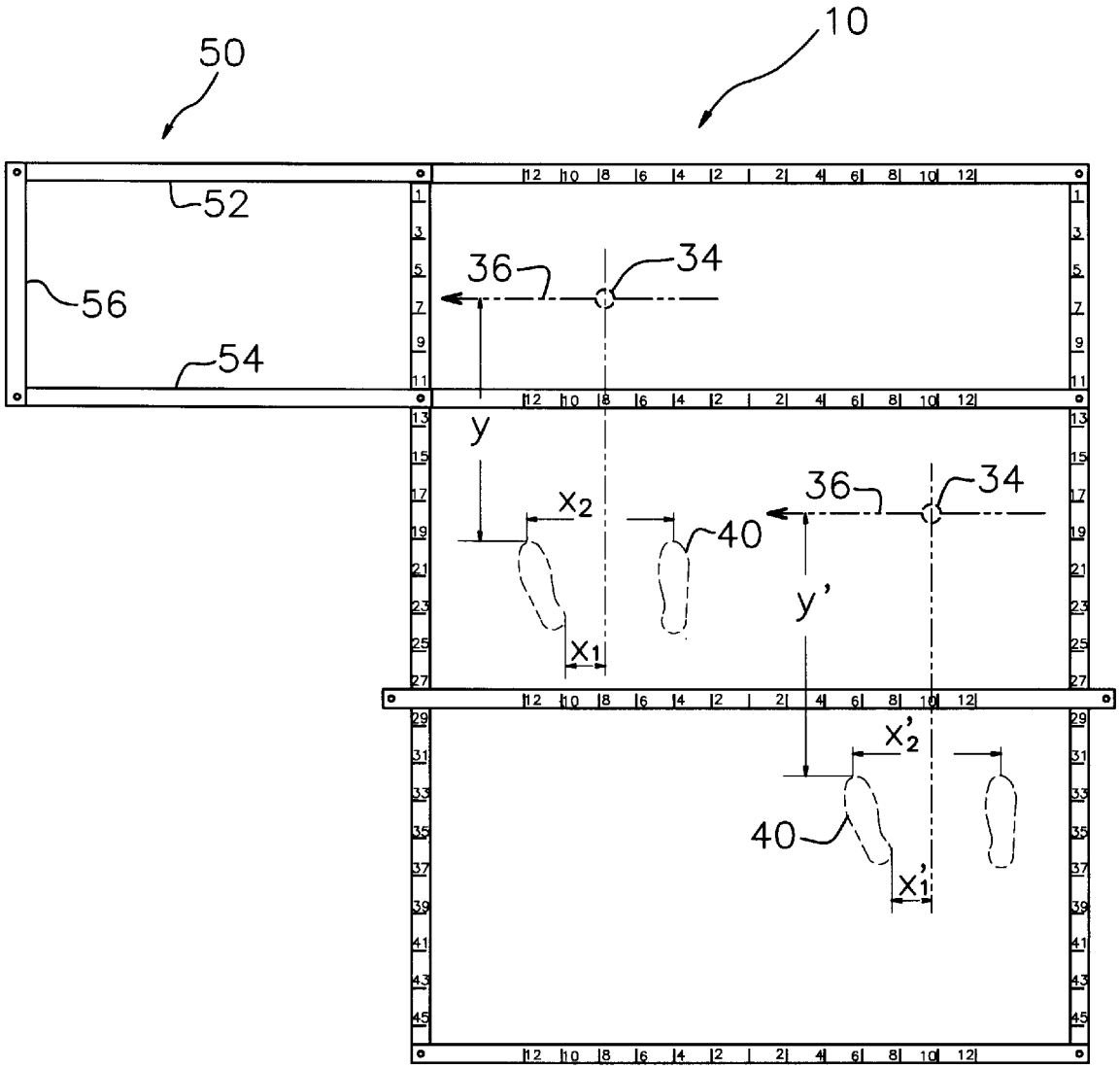
FIG. 3 is a perspective view of the present invention depicting consistent foot and stance placement in relation to a ball placement (feet and ball shown in phantom).

Referring now to the drawings, in particular FIGS. 1–4, the invention, depicted generally as 10, is a portable golf training apparatus for teaching consistent achievement of proper ball placement, correct alignment, proper foot placement and stance, and for providing a visual reference or target line in relation to alignment and foot position, comprising an internal array of flat elongated strips with a rectangular shape and further including an integral first flat intermediate elongated strip 18 and a second movable, as shown by arrow 60, flat intermediate elongated strip 20 as cross-members parallel to a first shorter side 16 and a second shorter side 22 of the rectangular array. The rectangular array of flat elongated strips and the flat intermediate cross-member elongated strips are generally made of a flexible and foldable material such as a nylon fabric strip.

Figure 4:
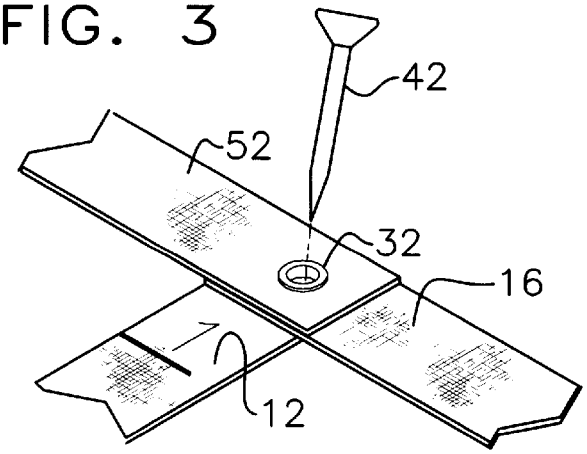
FIG. 4 is a perspective view depicting a method of holding down the present invention in a substantially flat layout.

The first and the second flat intermediate elongated cross-member strips, 18 and 20, are each located within the array 10 at a pre-determined spaced apart relationship, a distance between the first shorter side 16 of the array and the first flat intermediate elongated cross-member strip 18 closest the first shorter side 16 of the array 10 being less than a distance between the first and the second flat intermediate elongated cross-member strips, 18 and 20, and a distance between the second flat intermediate elongated cross-member strip 20 and the second shorter side 22 of the rectangular array 10. The invention further comprises a first and second longer side, 12 and 14 respectively, of the rectangular array 10, each further including incremental scale reference marks 26 and corresponding measurement numbers 28. The first and second shorter sides 16, 22 of the rectangular array 10 and the first and second flat intermediate elongated cross-member strips 18, 20 further include incremental scale referenced marks 24 and corresponding measurement numbers 30. Means 32 are also included at the junction of each shorter side and longer side array strip, including the junction of the first flat intermediate elongated cross-member strip 18 with the longer side strips 12, 14 of the array, for holding down the array in a substantially flat layout on a surface on which a golfer will practice. As depicted in FIG. 4, a golf tee 42 can be inserted through each eyelet 32 into the turf to maintain the present invention in a substantially flat orientation.

The first shorter side 16 and the first flat intermediate elongated cross-member strip 18 closest and parallel to said first shorter side 16 provides references to visualize a target line 36 or to provide a visualized tunneled target line 38. The second shorter side 22 of the array 10 is a base line and the second flat intermediate elongated cross-member strip 20 is a movable mid-stance line, each providing references to visualize proper alignment, foot placement and stance in relation to ball 34 placement.

In one embodiment of the present invention, the means 32 for holding down the array 10 in a substantially flat layout on a surface on which a golfer will practice comprises an eyelet at each junction, except for the second flat intermediate elongated cross-member strip 20 which includes an eyelet at each end of said second flat intermediate elongated cross-member strip 20, through which tees as shown in FIG. 4 or a stake can be inserted into the ground to secure the apparatus in place. As an alternative should the apparatus be used where a tee or stake is not capable of being used, the apparatus may be taped in place or a string may be tied to the eyelets and secured to a combination of available posts, trees or other appurtenances nearby.

In the preferred embodiment, the distance between the first shorter side 16 of the array 10 and the first flat intermediate elongated cross-member strip 18 closest and parallel to said first shorter side 16 is about one-half the distance between the first and second flat parallel intermediate elongated cross-member strips 18, 20 which is approximately equal to the distance between the second shorter side 22 of the array 10 and the second flat intermediate elongated cross-member strip 20 closest and parallel to said second shorter side 22.

An additional feature to the preferred embodiment includes an extension of the line of sight to assist the player in visualizing the line of sight relative to the swing of the club head. This is done by including a detachable array of flat elongated strips, generally depicted as 50, extending a line of sight beyond the rectangular shape array 10, the detachable array 50 including a first flat elongated extension strip 52 in line with the first shorter side 52 of the rectangular shape array and a second flat elongated extension strip 54 in line with the first flat intermediate elongated cross-member strip 18 and parallel to said first extension strip 16 and a third flat elongated strip 56 integrally connected to an end of each of the first and second flat elongated extension strips 52,54 and perpendicular to said strips, the length of the extension strips 52,54 being equal and generally about two feet long. The detachable array 50 is typically made from a flexible and foldable material or from a rigid material for use with a rigid array 10 as described below. The detachable array 50 further includes means 32, at the junction of the first and second extension strips 52,54 with the third flat elongated strip 56, for holding down the detachable array 50 in a substantially flat layout on a surface on which a golfer will practice, and means 32, at a free end of each first and second extension strip 52,54, for holding down the detachable array 50 free ends in a substantially flat layout on a surface on which a golfer will practice, wherein the means 32 at the free ends of the first and second extension strips 52,54 can be aligned with the corresponding means 32 for holding down the rectangular shape array 10. The means 32 for holding down the detachable array 50, including the free ends of the first and second extension strips 52,54 is typically an eyelet at each junction and free end.

In another embodiment of the present invention, a rigid array 10 is utilized which is contemplated to be suitable for repetitive use on a driving range or at a golfing school and for teaching consistent achievement of proper ball placement, correct alignment, proper foot placement and stance, and for providing a visual reference or target line in relation to alignment and foot position. This embodiment comprises the features of the above described embodiment except that instead of a flexible and foldable material from which the apparatus is made, the apparatus is made from a rigid material, preferably a light-weight polymeric plastic material or a rubber based material, although other materials may be used such as metal.

The present invention further includes a method of teaching proper golf alignment comprising the steps of providing a portable golf training apparatus 10 as described above for teaching consistent achievement of proper ball placement, correct alignment, proper foot placement and stance, and for providing a visual reference or target line in relation to alignment and foot position; sighting down the target line 36 to determine a target, aligning the first shorter side 16 of the rectangular array 10 in a direction substantially toward the target, and securing the portable golf training apparatus 10 at the hold down means 32 to a grass hitting area or to a hitting mat (not shown). The golfer then places a ball 34 within a target line 36 directly in line with a reference mark 24 on the first shorter side strip 16 and the first flat intermediate elongated cross-member strip 18 closest the shorter side strip 16. The golfer then positions his or her lead foot (shown in phantom in FIG. 3) so that the ball 34 is positioned to accommodate a golfer's swing and making a mental impression thereof from the reference marks 24 of the relative position of the lead foot to the ball placement. The golfer's trailing foot (shown in phantom in FIG. 3) is positioned so that a golfer's stance will widen as the golfer uses a wedge and transitions to a driver while maintaining a mental impression of the position of the feet in relation to the ball placement by visualizing the reference marks 24, 26. The golfer aligns a toe point of each foot, as well as the hips and head and shoulders such that both feet and hips and head and shoulders are square to the target line 36. The golfer then aligns a club face (not shown) square to the target using the first longer side 12 of the array 10 as a reference to ensure the club face is square and repetitively practices a golf swing with the golf club while making mental impressions of the golfer's alignment in relation to the ball placement and the target line 36. As an assist in projecting the line of sight, the golfer can provide the detachable array 50 as an extension of the shorter side 16 and the first flat intermediate elongated cross-member strip 18. The second flat intermediate elongated cross-member strip 20 is movable toward or away from the first flat intermediate elongated cross-member strip 18 wherein a golfer may adjust the alignment of the second intermediate elongated cross-member strip 20 to suit his or her stance.

As seen from the foregoing description, the present invention satisfies a need to provide an apparatus and method of using such apparatus, the apparatus being light-weight, easy to set up, and providing visual memory aids to teach and train a golfer the proper ball placement, stance, and alignment without having to make complicated adjustments whenever a different golfer uses the apparatus or whenever different clubs are used or when a divot is taken.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A portable golf training apparatus suitable for use on a grass hitting area or on a hitting mat, for teaching consistent achievement of proper ball placement, correct alignment, proper foot placement and stance, and for providing a visual reference or target line in relation to alignment and foot position, comprising:

an integral array of flat elongated strips with a rectangular shape and further including an integral first flat intermediate elongated strip and a second movable flat intermediate elongated strip as cross-members parallel to a first shorter side and a second shorter side of the rectangular array;

the rectangular array of flat elongated strips and the flat intermediate cross-member elongated strips being made of a flexible and foldable material;

the first and the second flat intermediate elongated cross-member strips, each being located within the array at a pre-determined spaced apart relationship wherein a distance between the first shorter side of the array and the first flat intermediate cross-member elongated strip closest the first shorter side of the array being less than a distance between the first and the second flat intermediate cross-member elongated strips and a distance between the second flat intermediate cross-member elongated strip and the second shorter side of the rectangular array;

a first and second longer side of the rectangular array, each further including incremental scale reference marks and corresponding measurement numbers;

the first and second shorter sides of the rectangular array and the first and second flat intermediate elongated cross-member strips further including incremental scale referenced marks and corresponding measurement numbers; and means, at the junction of each shorter side and longer side array strip, including at the junction of the first flat intermediate elongated cross-member strip with the longer side array strips and at each end of the second flat intermediate elongated cross-member strip, for holding down the array in a substantially flat layout on a surface on which a golfer will practice, wherein the first shorter side and the first flat intermediate elongated cross-member strip closest and parallel to said first shorter side provides references to visualize a target line and wherein the second shorter side of the array is a base line and the second flat intermediate elongated cross-member strip is a movable mid-stance line, each providing references to visualize proper alignment, foot placement and stance in relation to ball placement.

2. The golf training apparatus according to claim 1 wherein the means for holding down the array in a substantially flat layout on a surface on which a golfer will practice comprises an eyelet at each junction, except for the second flat intermediate elongated cross-member strip which includes an eyelet at each end of said second flat intermediate elongated cross-member strip.

3. The golf training apparatus according to claim 1 wherein the distance between the first shorter side of the array and the first flat intermediate elongated cross-member strip closest and parallel to said first shorter side is about one-half the distance between the first and second flat parallel intermediate cross-member elongated strips which is approximately equal to the distance between the second shorter side of the array and the second flat intermediate elongated cross-member strip closest and parallel to said second shorter side.

4. The golf training apparatus according to claim 1 further comprising:

a detachable array of flat elongated strips extending a line of sight beyond the rectangular shape array, the detachable array including a first flat elongated extension strip in line with the first shorter side of the rectangular shape array and a second flat elongated extension strip in line with the first flat intermediate elongated cross-member strip and parallel to said first extension strip and a third flat elongated strip integrally connected to an end of each of the first and second flat elongated extension strips and perpendicular to said strips, the length of the extension strips being equal;

the detachable array being made from a flexible and foldable material;

means, at the junction of the first and second extension strips with the third flat elongated strip, for holding down the detachable array in a substantially flat layout on a surface on which a golfer will practice; and means, at a free end of each first and second extension strip, for holding down the detachable array free ends in a substantially flat layout on a surface on which a golfer will practice, wherein the means at the free ends of the first and second extension strips can be aligned with the corresponding means for holding down the rectangular shape array.

5. The golf training apparatus according to claim 4, wherein the means for holding down the detachable array, including the free ends of the first and second extension strips is an eyelet at each junction and free end.

6. A golf training apparatus suitable for repetitive use on a driving range or at a golfing school for teaching consistent achievement of proper ball placement, correct alignment, proper foot placement and stance, and for providing a visual reference or target line in relation to alignment and foot position, comprising:

an integral array of flat elongated strips with a rectangular shape and further including an integral first flat intermediate elongated strip and a second movable flat intermediate elongated strip as cross-members parallel to a first shorter side and a second shorter side of the rectangular array;

the rectangular array of flat elongated strips and the flat intermediate cross-member elongated strips being made of a rigid material;

the first and the second flat intermediate elongated cross-member strips, each being located within the array at a pre-determined spaced apart relationship wherein a distance between the first shorter side of the array and the first flat intermediate cross-member elongated strip closest the first shorter side of the array being less than a distance between the first and the second flat intermediate cross-member elongated strips and a distance between the second flat intermediate cross-member elongated strip and the second shorter side of the rectangular array;

a first and second longer side of the rectangular array, each further including incremental scale reference marks and corresponding measurement numbers;

the first and second shorter sides of the rectangular array and the first and second flat intermediate elongated cross-member strips further including incremental scale referenced marks and corresponding measurement numbers; and means, at the junction of each shorter side and longer side array strip, including at the junction of the first flat intermediate elongated cross-member strip with the longer side array strips and at each end of the second flat intermediate elongated cross-member strip, for holding down the array in a substantially flat layout on a surface on which a golfer will practice, wherein the first shorter side and the first flat intermediate elongated cross-member strip closest and parallel to said first shorter side provides references to visualize a target line and wherein the second shorter side of the array is a base line and the second flat intermediate elongated cross-member strip is a movable mid-stance line, each providing references to visualize proper alignment, foot placement and stance in relation to ball placement.

7. The golf training apparatus according to claim 6 wherein the means for holding down the array in a substantially flat layout on a surface on which a golfer will practice comprises an eyelet at each junction, except for the second flat intermediate elongated cross-member strip which includes an eyelet at each end of said second flat intermediate elongated cross-member strip.

8. The golf training apparatus according to claim 6, wherein the distance between the first shorter side of the array and the first flat intermediate elongated cross-member strip closest and parallel to said first shorter side is about one-half the distance between the first and second flat parallel intermediate cross-member elongated strips which is approximately equal to the distance between the second shorter side of the array and the second flat intermediate elongated cross-member strip closest and parallel to said second shorter side.

9. The golf training apparatus according to claim 6 further comprising:

a detachable array of flat elongated strips extending a line of sight beyond the rectangular shape array, the detachable array including a first flat elongated extension strip in line with the first shorter side of the rectangular shape array and a second flat elongated extension strip in line with the first flat intermediate elongated cross-member strip and parallel to said first extension strip and a third flat elongated strip integrally connected to an end of each of the first and second flat elongated extension strips and perpendicular to said strips, the length of the extension strips being equal;

the detachable array being made from a rigid material;

means, at the junction of the first and second extension strips with the third flat elongated strip, for holding down the detachable array in a substantially flat layout on a surface on which a golfer will practice; and means, at a free end of each first and second extension strip, for holding down the detachable array free ends in a substantially flat layout on a surface on which a golfer will practice, wherein the means at the free ends of the first and second extension strips can be aligned with the corresponding means for holding down the rectangular shape array.

10. The golf training apparatus according to claim 9, wherein the means for holding down the detachable array, including the free ends of the first and second extension strips is an eyelet at each junction and free end.

11. A method of teaching proper golf alignment comprising the steps of:

(a) providing a portable golf training apparatus suitable for use on a grass hitting area or on a hitting mat, for teaching consistent achievement of proper ball placement, correct alignment, proper foot placement and stance, and for providing a visual reference or target line in relation to alignment and foot position, the apparatus having an integral array of flat elongated strips with a rectangular shape and further including an integral first flat intermediate elongated strip and a second movable flat intermediate elongated strip as cross-members parallel to a first shorter side and a second shorter side of the rectangular array, the rectangular array of flat elongated strips and the flat intermediate elongated cross-member strips being made of a flexible and foldable material, the first and second flat intermediate elongated cross-member strips, each being located within the array at a pre-determined spaced apart relationship, a distance between the first shorter side of the array and the first flat intermediate elongated cross-member strip closest the first shorter side of the array being less than a distance between the first and the second flat intermediate elongated cross-member strips and a distance between the second flat intermediate elongated cross-member strip and the second shorter side of the rectangular array, a first and second longer side of the rectangular array, each further including incremental scale reference marks and corresponding measurement numbers, the first and second shorter sides of the rectangular array and the first and second flat intermediate elongated cross-member strips further including incremental scale referenced marks and corresponding measurement numbers, and means, at the junction of each shorter side and longer side array strip, including the junction of the first flat intermediate elongated cross-member strip with the longer side array strips and at each end of the second flat intermediate elongated cross-member strip, for holding down the array in a substantially flat layout on a surface on which a golfer will practice, wherein the first shorter side and the first flat intermediate elongated cross-member strip closest and parallel to said first shorter side provides references to visualize a target line and wherein the second shorter side of the array is a base line and the second flat intermediate elongated cross-member strip is a movable mid-stance line, each providing references to visualize proper alignment, foot placement and stance in relation to ball placement;

(b) sighting down the target line to determine a target, aligning the first shorter side of the rectangular array in a direction substantially toward the target, and securing the portable golf training apparatus at the hold down means to a grass hitting area or to a hitting mat;

(c) placing a ball within a target line directly in line with a reference mark on the first shorter side strip and the first flat intermediate elongated cross-member strip closest the shorter side strip;

(d) positioning a golfer's lead foot so that the ball is positioned to accommodate a golfer's swing and noting the reference marks of the relative position of the lead foot to the ball placement;

(e) positioning a golfer's trailing foot so that a golfer's stance will widen as the golfer uses a wedge and transitions to a driver while noting the position of the feet in relation to the ball placement by visualizing the reference marks;

(f) aligning a toe point of each foot, hips and a head and shoulders of the golfer such that both feet and hips and head and shoulders are square-to the target line;

(g) aligning a club face square to the target using the first longer side of the array as a reference to ensure club face is square; and (h) repetitively practicing a golf swing with each golf club while noting alignment in relation to the ball placement and the target line.

12. The method of teaching proper golf alignment according to claim 11 further comprising the steps of:

(a) providing a detachable array of flat elongated strips extending a line of sight beyond the rectangular shape array, the detachable array including a first flat elongated extension strip in line with the first shorter side of the rectangular shape array and a second flat elongated extension strip in line with the first flat intermediate elongated cross-member strip and parallel to said first extension strip and a third flat elongated strip integrally connected to an end of each of the first and second flat elongated extension strips and perpendicular to said strips, the length of the extension strips being equal, the detachable array being made from a flexible and foldable material, the detachable array including means, at the junction of the first and second extension strips with the third flat elongated strip, for holding down the detachable array in a substantially flat layout on a surface on which a golfer will practice, and the detachable array further including means, at a free end of each first and second extension strip, for holding down the detachable array free ends in a substantially flat layout on a surface on which a golfer will practice, wherein the means at the free ends of the first and second extension strips can be aligned with the corresponding means for holding down the rectangular shape array; and (b) securing the detachable array at the hold down means to a grass hitting area or to a hitting mat.

13. A method of teaching proper golf alignment comprising the steps of:

(a) providing a golf training apparatus suitable for repetitive use on a driving range or at a golfing school for teaching consistent achievement of proper ball placement, correct alignment, proper foot placement and stance, and for providing a visual reference or target line in relation to alignment and foot position, the apparatus having an integral array of flat elongated strips with a rectangular shape and further including an integral first flat intermediate elongated strip and a second movable flat intermediate elongated strip as cross-members parallel to a first shorter side and a second shorter side of the rectangular array, the rectangular array of flat elongated strips and the flat intermediate elongated cross-member strips being made of a rigid material, the first and the second flat intermediate elongated cross-member strips, each being located within the array at a pre-determined spaced apart relationship, a distance between the first shorter side of the array and the first flat intermediate elongated cross-member strip closest the first shorter side of the array being less than a distance between the first and the second flat intermediate elongated cross-member strips and a distance between the second flat intermediate elongated cross-member strip and the second shorter side of the rectangular array, a first and second longer side of the rectangular array, each further including incremental scale reference marks and corresponding measurement numbers, the first and second shorter sides of the rectangular array and the first and the second flat intermediate elongated cross-member strips further including incremental scale referenced marks and corresponding measurement numbers, and means, at the junction of each shorter side and longer side array strip, including the junction of the first flat intermediate elongated cross-member strip with the longer side strips of the array and at each end of the second flat intermediate elongated cross-member strip, for holding down the array in a substantially flat layout on a surface on which a golfer will practice, wherein the first shorter side and the first flat intermediate elongated cross-member strip closest and parallel to said first shorter side provides references to visualize a target line and wherein the second shorter side of the array is a base line and the second flat intermediate elongated cross-member strip is a movable mid-stance line, each providing references to visualize proper alignment, foot placement and stance in relation to ball placement;

(b) sighting down the target line to determine a target, aligning the first shorter side of the rectangular array in a direction substantially toward the target, and securing the golf training apparatus at the hold down means to a grass hitting area or to a hitting mat;

(c) placing a ball within a target line directly in line with a reference mark on the first shorter side strip and the first flat intermediate elongated cross-member strip closest the shorter side strip;

(d) positioning a golfer's lead foot so that the ball is positioned to accommodate a golfer's swing and noting impression thereof from the reference marks of the relative position of the lead foot to the ball placement;

(e) positioning a golfer's trailing foot so that a golfer's stance will widen as the golfer uses a wedge and transitions to a driver while noting the position of the feet in relation to the ball placement by visualizing the reference marks;

(f) aligning a toe point of each foot, hips and a head and shoulders of the golfer such that both feet and hips and head and shoulders are square to the target line;

(g) aligning a club face square to the target using the first longer side of the array as a reference to ensure club face is square; and (h) repetitively practicing a golf swing with each golf club while noting alignment in relation to the ball placement and the target line.

14. The method of teaching proper golf alignment according to claim 13 further comprising the steps of:

(a) providing a detachable array of flat elongated strips extending a line of sight beyond the rectangular shape array, the detachable array including a first flat elongated extension strip in line with the first shorter side of the rectangular shape array and a second flat elongated extension strip in line with the first flat intermediate elongated cross-member strip and parallel to said first extension strip and a third flat elongated strip integrally connected to an end of each of the first and second flat elongated extension strips and perpendicular to said strips, the length of the extension strips being equal, the detachable array being made from a rigid material, the detachable array including means, at the junction of the first and second extension strips with the third flat elongated strip, for holding down the detachable array in a substantially flat layout on a surface on which a golfer will practice, and the detachable array further including means, at a free end of each first and second extension strip, for holding down the detachable array free ends in a substantially flat layout on a surface on which a golfer will practice, wherein the means at the free ends of the first and second extension strips can be aligned with the corresponding means for holding down the rectangular shape array; and (b) securing the detachable array at the hold down means to a grass hitting area or to a hitting mat.

* * * * *

(Also Form PTO-1050)

UNITED STATES PATENT AND TRADEMARK OFFICE

CERTIFICATE OF CORRECTION

PATENT NO : 5,984,801

DATED : November 16, 1999

INVENTOR(S) : Robert B. Mason

It is certified that error appears in the above-identified patent and that said Letters Patent is hereby corrected as shown below:

Col. 9, line 21
replace "square-to"
with --square to--.

Col. 9, line 26
replace "while noting alignment"
with --while noting the golfer's alignment--.

Col. 10, lines 50 - 51
replace "noting impression thereof from the"
with --noting the--.

Col. 10, line 65
replace "while noting alignment"
with --while noting the golfer's alignment--.

Signed and Sealed this

Thirtieth Day of May, 2000

*Attest:*

Q. TODD DICKINSON

*Attesting Officer*

*Director of Patents and Trademarks*